United States Patent [19]

Davenport et al.

[11] 4,051,556

[45] Oct. 4, 1977

[54] CHIN STRAP FOR PROTECTIVE HEADGEAR

[75] Inventors: Stanley Davenport, Knoxville, Tenn.; Frank K. Villari, Oak Park, Ill.

[73] Assignee: The Kendall Company, Boston, Mass.

[21] Appl. No.: 734,209

[22] Filed: Oct. 20, 1976

[51] Int. Cl.[2] ..... A42B 7/00

[52] U.S. Cl. ..... 2/421

[58] Field of Search ..... 2/421, 9, 6, 410

[56] References Cited

U.S. PATENT DOCUMENTS

| | | | |
|---|---|---|---|
| 2,846,683 | 8/1958 | Dye et al. | 2/421 |
| 2,850,740 | 9/1958 | Adams | 2/9 |
| 2,867,811 | 1/1959 | Jones | 2/421 |
| 2,886,818 | 5/1959 | Roberts | 2/421 |
| 2,985,883 | 5/1961 | Marietta | 2/9 |
| 3,166,761 | 1/1965 | Strohm | 2/421 |
| 3,311,921 | 4/1967 | Helm | 2/421 |
| 3,873,997 | 4/1975 | Gooding | 2/421 |

*Primary Examiner*—Alfred R. Guest

*Attorney, Agent, or Firm*—Powell L. Sprunger

[57] ABSTRACT

A chin strap for protective headgear comprising, an elongated first strap having means for attaching opposed end portions of the first strap to the headgear. The chin strap has a second strap having opposed ends connected to the first strap at spaced first and second points in a central portion of the first strap, with the first and second straps being spaced from each other intermediate the connecting points. The chin strap has a third strap having one end connected to the first strap at a third point intermediate the first and second connecting points and adjacent the first connecting point, and having means for attaching the other end portion of the third strap to the headgear. The chin strap has a fourth strap having one end connected to the first strap at a fourth point intermediate the first and second connecting points and adjacent the second connecting point, and having means for connecting the other end portion of the fourth strap to the headgear. The chin strap also has a chin cup extending between the spaced portions of the first and second straps.

8 Claims, 12 Drawing Figures

Fig. 1
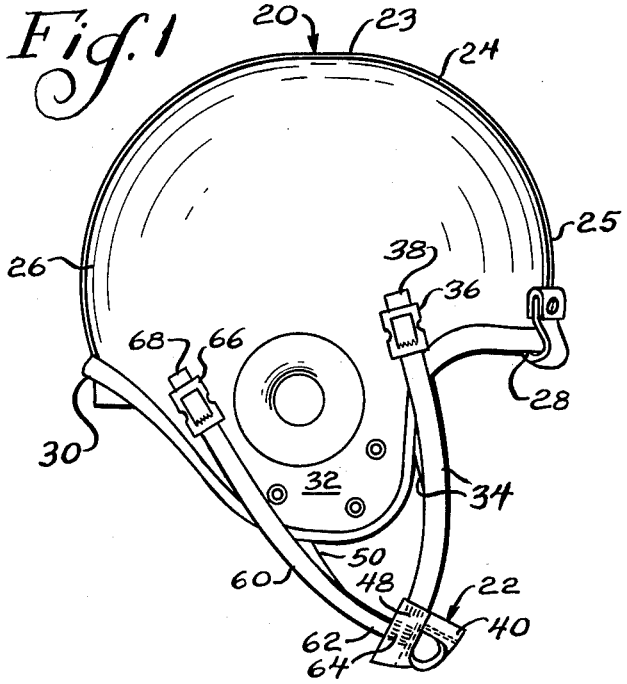
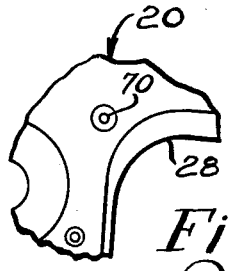
Fig. 2
Fig. 3
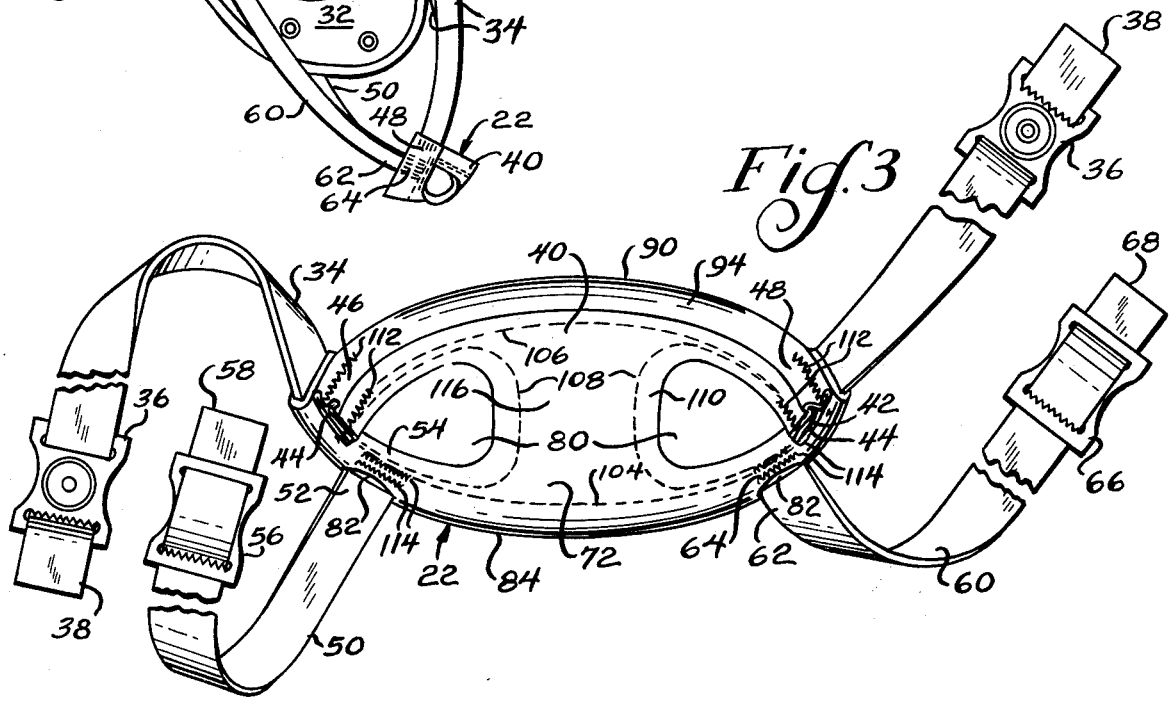
Fig. 4
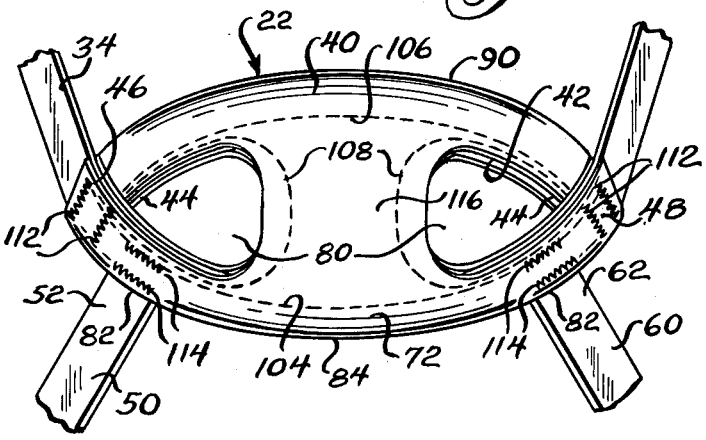
Fig. 12
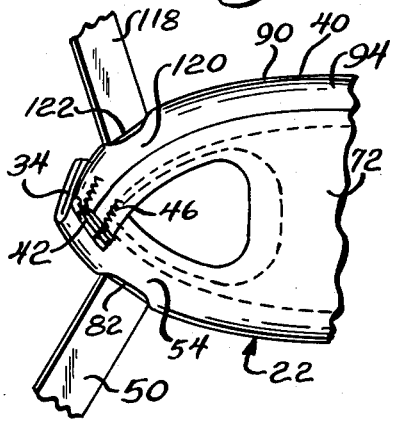

CHIN STRAP FOR PROTECTIVE HEADGEAR

BACKGROUND OF THE INVENTION

The present invention relates to protective headgear, and more particularly to chin straps for such headgear.

A various assortment of protective headgear or helments has been proposed in the past for protecting the wearer's head in the event of a collision. Such helments have been widely utilized by participants in a number of sports, where the possibility of head injury is great, such as football, hockey, and baseball, and for other purposes, such as crash helmets. Of course, it is necessary to retain the headgear at the proper position on the wearer's head during use, in order to minimize the possibility that the wearer may be injured when struck. Chin straps have been provided for this purpose, and generally include a chin cup positioned against the wearer's chin and one or more straps extending from the chin cup to the headgear in order to retain the headgear in place on the wearer. A chin strap has been proposed which utilizes two straps which cross at spaced points in the region of the chin cup for the purpose of stabilizing the helmet on the wearer's head. However, it has been found that this arrangement of straps does not properly distribute forces against the chin, and particularly the front part of the chin where the forces are directly applied from the helmet against the chin through the straps. Additionally, it is desirable to provide a chin strap which affords maximum comfort to the wearer during use of the helmet.

SUMMARY OF THE INVENTION

A principal feature of the present invention is the provision of a chin strap for protective headgear which provides improved comfort to the wearer's chin.

The chin strap of the present invention comprises, an elongated first strap having means for attaching opposed end portions of the first strap to the headgear. The chin strap has a second strap having opposed ends connected to the first strap at spaced first and second points in a central portion of the first strap, with the first and second straps being spaced from each other intermediate the connecting points. The chin strap has a third strap having one end connected to the first strap at a third point intermediate the first and second connecting points and adjacent the first connecting point, and having means for attaching the other end portion of the third strap to the headgear. The chin strap has a fourth strap having one end connected to the first strap at a fourth point intermediate the first and second connecting points and adjacent the second connecting point, and having means for connecting the other end portion of the fourth strap to the headgear. The chin strap also has a chin cup extending between the spaced portions of the first and second straps.

A feature of the present invention is that forces applied to the third and fourth straps are not directly applied to the second strap, and the forces are distributed through the first strap and the chin cup in order to prevent excessive forces being applied to the second strap and the wearer's chin during use of the helmet.

Thus, a feature of the present invention is that the chin strap prevents the application of excessive forces against the wearer's chin in the region of the second strap, and against the front part of the chin where the second strap is preferably located during use of the headgear.

Another feature of the invention is that the chin strap provides additional comfort to the wearer's chin during use of the headgear.

Yet another feature of the invention is that the third and fourth straps tend to open the chin cup when forces are applied to these straps rather than causing the second strap to bind against the wearer's chin.

Still another feature of the invention is that in a preferred form the chin cup comprises a single sheet of flexible material, and the third and fourth straps extend from a location inside the sheet through slits in the sheet.

Another feature of the invention is that the sheet has an inverted seam adjacent an outer edge of the second strap defining an enlargement to provide a better fit for the wearer's chin.

Thus, a feature of the invention is that the chin cup provides a relatively smooth conforming surface for additional comfort to the wearer's chin during use.

A feature of the invention is that an alternative embodiment the straps which connect the chin cup to the headgear are attached to straps in the cup at locations spaced from ends of the cup straps to provide an improved distribution of forces in the cup.

Further features will become more fully apparent in the following description of the embodiments of this invention and from the appended claims.

DESCRIPTION OF THE DRAWINGS

In the drawings:

FIG. 1 is a side elevational view of a protective helmet or headgear having a chin strap of the present invention;

FIG. 2, is a fragmentary view of the helmet of FIG. 1;

FIG. 3 is a fragmentary inside plan view of the chin strap of FIG. 1;

FIG. 4 is a fragmentary outside plan view of the chin strap of FIG. 3;

FIG. 12 is a fragmentary inside plan view of another embodiment of the chin strap of the present invention.

DESCRIPTION OF THE PREFERRED EMBODIMENTS

Figure 6:
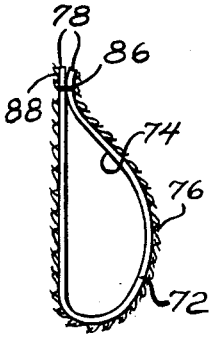
FIG. 6 is a sectional view of the sheet of FIG. 5 during a stage of construction of the chin cup.

Referring now to FIG. 1, there is shown a protective helmet generally designated 20 having a chin strap generally designated 22. Although the helmet 20 is shown in the form of a football helmet, it will be understood that the chin strap may be utilized in connection with any other suitable headgear, such as hockey helmets, baseball helmets, crash helmets, or other headgear where protection of a head is desired. As shown, the helment 20 has an outer shell 24 which is preferably made of a relatively rigid material, such as polycarbonate alloy, a rigid thermoplastic, or a thermosetting resin. The shell 24 has an upper central portion 23, a front portion 25, a rear portion 26, a lower front edge 28, a lower rear edge 30, and a pair of ear protectors 32.

With reference to FIGS. 1, 3, and 4, the chin strap 22 has an elongated first inelastic strap 34 having a pair of sliding fasteners 36 on opposed outer end portions 38 of the first strap 34 for attaching the first strap 34 to the helmet 20. The chin strap 22 has a chin cup 40, as will be further described below, and a second inelastic strap 42 inside the cup 40 and having opposed ends 44 connected to the first strap 34 at spaced first and second points 46 and 48, respectively, in a central portion of the first strap 34. As shown, the first and second straps 34 and 42 are spaced from each other intermediate the connecting points 46 and 48. The chain strap 22 has a third strap 50 having one end 52 connected to the first strap 34 at a third point 54 intermediate the first and second connecting points 46 and 48 and adjacent the first connecting point 46. The third strap 50 has a sliding fastener 56 for attaching the other end portion 58 of the third strap 50 to the headgear or helmet 20. The chin strap also has a fourth inelastic strap 60 having one end 62 connected to the first strap 34 at a fourth point 64 intermediate the first and second connecting points 46 and 48 and adjacent the second connecting point 48. The fourth strap has a sliding fastener 66 on the other end portion 68 of the fourth strap 60 for attaching the fourth strap 60 to the headgear 20. As shown, the chin cup 40 extends between the spaced portions of the first and second straps 34 and 42, respectively.

With reference to FIGS. 1 and 2, the fasteners of the straps may be attached to the headgear in the following manner. As shown in FIG. 2, the helmet 20 has a plurality of outwardly projecting male snap elements 70, and the associated fasteners on the straps have cooperating female portions which may be releasably attached to the elements 70. Referring to FIG. 1, the first strap 34 has its two end portions 38 secured by the fasteners 36 on opposed forward parts of the helmet ear protectors 32. Also, the third and fourth inelastic straps 50 and 60 have their respective end portions attached to a rearward part of the ear protectors 32 on opposed sides of the helmet. Of course, the length of the straps between the respective fasteners and the chin cup may be suitably adjusted by movement of the straps in the fasteners. The first strap 34 and rearwardly located third and fourth straps 50 and 60 stabilize the helmet on the wearer's head during use, and, as will be seen below, the forces applied to the third and fourth straps are distributed through the chin cup 40.

Figure 7:
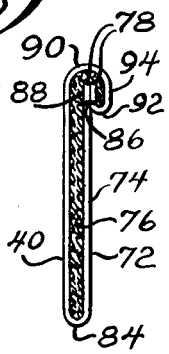
FIG. 7 is a sectional view of the sheet of FIG. 5 showing the chin cup in a stage of construction prior to insertion of straps.
Figure 5:
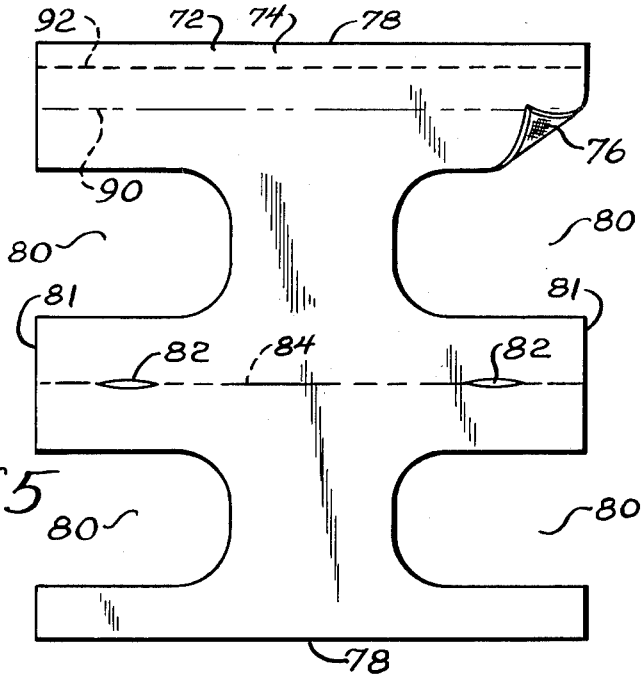
FIG. 5 is a plan view of a sheet of flexible material for use in constructing a chin cup for the chin strap of FIG. 1.

The structure of the chin strap will be more fully understood by a description of the manner in which it is constructed. As shown in FIG. 5, the chin cup comprises a sheet 72 of flexible material, such as a poromeric polyvinyl chloride material defining a soft porous outer surface 74 of the sheet 72 and having a reinforcement backing of woven material on an inner surface 76 of the sheet 72, e.g., a material sold under the trademark PORON by Rogers Corporation. As shown, the sheet 72 has a pair of opposed edges 78, a plurality of cutouts 80 extending from opposed sides 81 of the sheet 72, and a pair of spaced slits 82 along a fold line 84 extending between the sides 81 of the sheet 72. With reference to FIG. 6, the opposed edges 78 of the sheet 72 are folded together with the inner surface 76 of the sheet 72 facing outwardly from the folded sheet, and the edges 78 are secured together by suitable means, such as by a line 86 of stitching forming a seam 88 in the sheet 72. Next, with reference to FIG. 7 the sewn sheet 72 is inverted such that its outer surface 74 faces outwardly from the inverted sheet, and the seam 88 is inverted and directed inwardly from the inverted sheet. In a preferred form, as shown, the edges 78 of the inverted seam 88 are directed toward an outer fold line 90 of the sheet 72, and the sheet 72 has a fold line 92 adjacent the seam 88 defining an enlarged portion 94 of the sheet 72 intermediate the fold lines 90 and 92 for a purpose which will be described below. Although for convenience the cutouts 80 and slits 82 are shown in the sheet 72 of FIG. 5, it will be understood that the cutouts and slits may be made at any appropriate stage during fabrication, such as after inverting the sheet into the configuration of FIG. 7.

Figure 8:
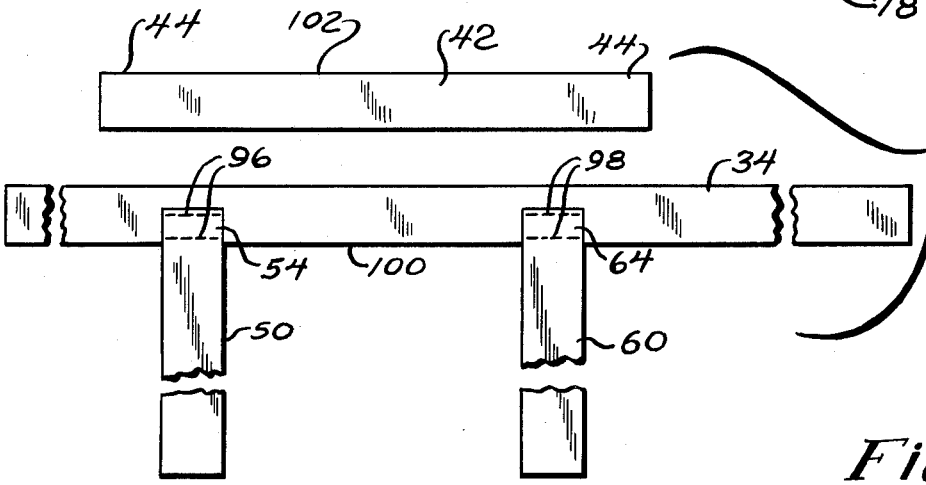
FIG. 8 is a fragmentary plan view of straps for the chin strap of the present invention.
Figure 10:
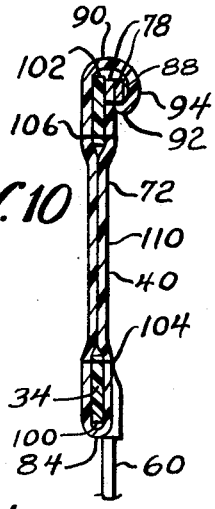
FIG. 10 is a sectional view taken substantially as indicated along the line 10—10 of FIG. 9.
Figure 9:
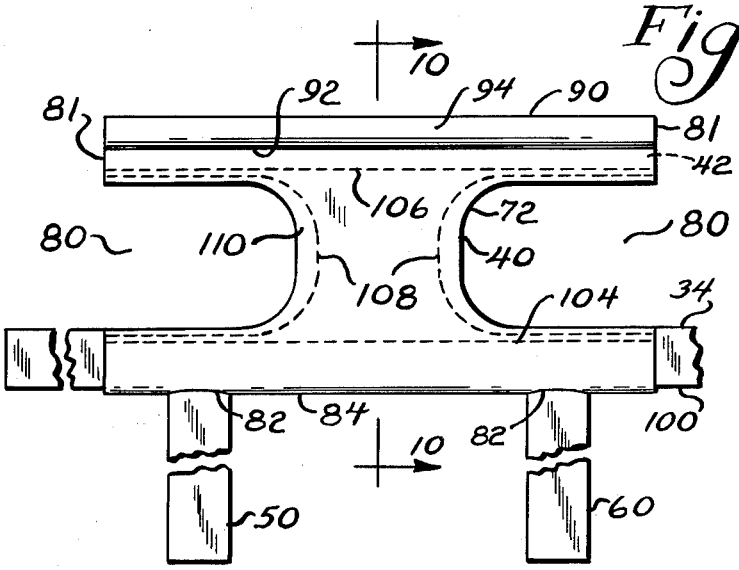
FIG. 9 is a fragmentary plan view of the chin strap during a further stage of construction.

Next, with reference to FIG. 8, the first strap 34, second strap 42, third strap 50, and fourth strap 60 are cut to length, and the third and fourth straps 50 and 60 are attached to the central portion of the first strap 34 at the third and fourth connecting point 54 and 64 by suitable means, such as by respective lines 96 and 98 of stitching. With reference to FIGS. 8-10, the first strap 34 and connected third and fourth straps 50 and 60 are passed inside the folded sheet 72 or chin cup 40 of FIG. 7, and the third and fourth straps 50 and 60 are passed through the slits 82 in the fold line 84, such that the third and fourth straps 50 and 60 extend from the first strap 34 through the slits 82 to the outside of the sheet with an outer edge 100 of the first strap 34 being located adjacent the outer fold line 84 of the folded sheet 72. Also, the second strap 42 is passed inside the folded sheet 72 of FIG. 7, with an outer edge 102 of the second strap 42 being located adjacent the fold line 90 of the sheet. As shown in FIG. 9, the spaced cutouts 80 on each side 81 are aligned to provide opposed cutouts at each side of the folded sheet 72. At this time, the sheet 72 may be secured to the first strap 34 by a line 104 of stitching and to the second strap 42 by a line 106 of stitching, and the sheet 72 may be secured together around the cutouts 80 by suitable lines 108 of stitching.

Figure 11:
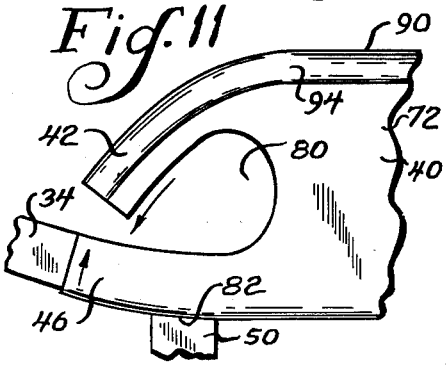
FIG. 11 is a fragmentary plan view showing another stage in the construction of the chip strap of the present invention.

In this configuration, with reference to FIGS. 9 and 10, the sheet 72 is secured to the first and second straps 34 and 42, the third and fourth straps 50 and 60 extend from the first strap 34 through the slits 82 in the sheet 72, and the enlarged portion 94 of the sheet 72 is directed outwardly from an inner surface 110 of the chin cup 40. Also, as shown in FIG. 10, the edges 78 of the inverted seam 88 are directed toward and are generally aligned with the outer edge 102 of the second strap 42. With reference to FIGS. 3 and 11, the outer opposed ends of the covered second strap 42 are drawn toward the spaced first and second points 46 and 48 of the first strap 34, and the second strap 42 is connected to the first strap 34 by suitable lines 112 of stitching. Also, as shown in FIGS. 3 and 4, the sheet 72 may be attached to the third and fourth straps 50 and 60 by suitable lines 114 of stitching. In the constructed configuration of the chin strap 40 illustrated in FIGS. 3 and 4, the second strap 42 and the central portion of the first strap 34, as well as the connecting points of the first, third, and fourth straps 34, 50, and 60, respectively, are covered by the flexible sheet 72 in order to provide a smooth comfortable inner surface 110 of the chin cup 40 and an aesthetically pleasing appearance of the cup. In addition, the enlarged sheet portion 94 overlying the inner surface of the second strap 42 is received in the recess above the front part of the wearer's chin, and provides a close fit between the chin and enlarged portion with smooth rounded edges for improved comfort to the wearer's chin during use of the helmet. Further, the smooth folded edge 84 of the cup 40 defined by the sheet 72 provides a smooth edge to prevent cutting by the first strap 34 into the wearer's chin during use.

With reference to FIGS. 1, 3, and 4, when forces are applied to the third and fourth straps 50 and 60 during use of the helmet, the forces are applied directly to the first strap 34 at locations between the first and second connecting points 46 and 48, rather than directly to the second strap 42. In this manner, the applied forces tend to separate the cup at the third and fourth conneecting points 54 and 64, and are distributed through a central part 116 of the cup sheet 72 and the first strap 34 prior to indirect application to the second strap 42. Thus, such forces are not applied directly to the second strap 42 which would otherwise cause application of excessive forces on the front part of the wearer's chin, and the chin strap of the present invention minimizes the possibility of harm to the wearer while providing improved comfort to the wearer's chin.

Another embodiment of the present invention is illustrated in FIG. 12, in which like reference numerals designate like parts. For convenience, only one side portion of the cup is shown, although it will be understood that the remaining portion of the cup is substantially symmetrical to the illustrated part. In this embodiment, the first strap 34 only extends the width of the chin cup 40, and the first strap 34 and second strap 42 have opposed ends connected together at spaced first and second connecting points, e.g., 46, in a manner as previously described. As before, the third and fourth straps, e.g., 50, are connected to the first strap 34 at spaced third and fourth connecting points, e.g., 54, intermediate the first and second connecting points and adjacent the respective first and second connecting points. In this embodiment, the chin strap 40 has fifth and sixth inelastic straps, e.g., 118, connected to ends of the second strap 42 in a manner similar to that described in connection with the first, third, and fourth straps. Thus, the fifth and sixth straps are connected to the second strap 42 at spaced fifth and sixth points, e.g., 120, intermediate the first and second connecting points of the first and second straps and adjacent the respective first and second connecting points. As shown, the fifth and sixth straps 118 extend from the second strap 42 through appropriate slits, e.g., 122, in the sheet 72, in a manner as previously described in connection with the slits 82 for the third and fourth straps. Thus, when forces are applied to the fifth and sixth straps 118, the forces are applied to the second strap 42, rather than directly against the first strap 34. In this manner, such applied forces are distributed through the sheet 72 and second strap 42, and are indirectly applied to the first strap 34 from the second strap 42, in order to prevent the application of excessive forces through the first strap 34 against the lower part of the wearer's chin. Thus, when forces are applied to the third, fourth, fifth, and sixth straps during use of the helmet, the forces tend to separate the chin cup 40, rather than causing excessive pressure against the front and lower parts of the wearer's chin.

The foregoing detailed description is given for clearness of understanding only, and no unnecessary limitations should be understood therefrom, as modifications will be obvious to those skilled in the art.

We claim:

1. A chin strap for protective headgear, comprising:

an elongated first strap having means for attaching opposed end portions of the first strap to the headgear;

a second strap having opposed ends connected to the first strap at spaced first and second points in a central portion of the first strap, said first and second straps being spaced from each other intermediate the connecting points;

a third strap having one end connected to the first strap at a third point intermediate said first and second connecting points and adjacent said first connecting point, and having means for attaching the other end portion of the third strap to headgear;

a fourth strap having one end connected to the first strap at a fourth point intermediate said first and second connecting points and adjacent said second connecting point, and having means for connecting the other end portion of the fourth strap to the headgear; and a chin cup extending between the spaced portions of said first and second straps.

2. The strap of claim 1 wherein said chip cup comprises at least one sheet of flexible material covering said second strap and a central portion of the first strap intermediate said first and second connecting points.

3. The strap of claim 2 wherein said cup has an inner and outer web extending between the first and second straps.

4. The strap of claim 2 wherein said cup comprises a single sheet of flexible material extending around the outside of said first and second straps.

5. The strap of claim 4 wherein said sheet has a fold adjacent an outer edge of the first strap.

6. The strap of claim 5 wherein said third and fourth straps are connected directly to said first strap inside said sheet, and said sheet includes a pair of spaced slits in the fold adjacent said third and fourth connecting points, with said third and fourth straps extending from the first through said slits.

7. The strap of claim 4 wherein said sheet has a pair of opposed edges secured together along an inverted seam directed inwardly relative an outer surface of the sheet, said seam being located over an inner surface of the second strap adjacent an outer edge of the second strap, said seam defining an enlargement of the sheet on the inside of the cup adjacent the outer edge of the second strap.

8. The strap of claim 7 wherein said seam is directed toward the outer edge of the second strap with the opposed edges of the sheet being located adjacent the outer edge of the second strap.

* * * * *